United States Patent [19]

Tanzola

[11] Patent Number: 4,988,311

[45] Date of Patent: Jan. 29, 1991

[54] TERMINAL BLOCKS

[75] Inventor: Charles Tanzola, Long Valley, N.J.

[73] Assignee: AT&T Bell Laboratories, Murray Hill, N.J.

[21] Appl. No.: 447,299

[22] Filed: Dec. 7, 1989

[51] Int. Cl.[5] ..... H01R 4/24

[52] U.S. Cl. ..... 439/404; 439/389; 439/411

[58] Field of Search ..... 439/409, 410, 411, 417, 439/418, 419, 425, 426, 428, 395–400, 404, 719, 389

[56] References Cited

U.S. PATENT DOCUMENTS

| | | | |
|---|---|---|---|
| 2,719,957 | 10/1955 | Abbott | 439/411 |
| 3,139,315 | 6/1964 | Baldo | 439/409 |
| 3,596,232 | 7/1971 | Medley | 439/410 |
| 4,256,360 | 3/1981 | Debaight | 439/399 |
| 4,642,873 | 2/1987 | Bower, Jr. et al. . | |
| 4,702,538 | 10/1987 | Hutter et al. . | |
| 4,820,192 | 4/1989 | Denkmann et al. . | |
| 4,826,449 | 5/1989 | Debortoli et al. | 439/411 |

*Primary Examiner*—David L. Pirlot
*Attorney, Agent, or Firm*—L. H. Birnbaum

[57] ABSTRACT

Disclosed is a terminal block for providing electrical connection to insulated wire pairs. An entrance port of the block includes a blade for separating the wires as they are inserted therein. The wires are then positioned above a respective one of a pair of insulation displacement contacts. Pressure applied to the top of the block, as by screwing, drives each wire into its associated contact thereby causing penetration of the insulation for electrical connection. Posts may also be molded into the block to provide strain relief for the wires.

8 Claims, 3 Drawing Sheets

TERMINAL BLOCKS

BACKGROUND OF THE INVENTION

This invention relates to contact terminals.

Many portions of electronic apparatus require, or could benefit from, a terminal which provides a quick electrical connection to a pair of insulated current-carrying wires. For example, telephone wires must be electrically connected to equipment located on the side of the home. Typically, this connection is done by a craftsperson who strips off the insulation at the ends of the wires and wraps the wires around binding posts electrically connected to the equipment.

As should be appreciated, this method is rather time consuming and involves some degree of skill on the part of a craftsperson.

It is desirable in this application, and wherever insulated wire pairs are used, to provide a means for quick electrical connection of the wires. It is also desirable to provide means for preventing undue bending of the wires after they are connected to avoid breakage of the wires or loosening of the connection.

It has been recognized in the art that insulation displacement contacts can be utilized to connect wires in a speedy fashion. Such contacts include openings for the wires comprising sharp edges which cut through the wires as they are inserted therein (see, for example, U.S. Pat. No. 4,702,538 issued to Hutter et al, and U.S. Pat. No. 4,820,192 issued to Denkmann et al). Some strain relief mechanism has also been proposed for use in connection with such contacts (see, eg, U.S. Pat. No. 4,642,873 issued to Bower, Jr. et al). However, the prior art schemes generally have required manual separation of the wires before insertion into the contacts thereby compromising the speed of connection.

It is, therefore, an object of the invention to provide a terminal which permits a quick connection of insulated pairs of wires.

SUMMARY OF THE INVENTION

This and other objects are realized in accordance with the invention which is a terminal block comprising a housing with an entrance port defined therein. A separation member including a sharp edge is located at the entrance port, and a pair of contact members are situated within the housing. Each contact member includes an opening for insertion of a wire therein, the opening being defined by edges which are capable of piercing insulation surrounding the wire. The contact members are aligned with the entrance port and separation member so that insertion of an insulated wire pair into the block separates the wires and positions each above an opening in an associated contact member. Means are also provided for pressing each wire into the opening of its associated contact member.

BRIEF DESCRIPTION OF THE DRAWING

These and other features of the invention are delineated in detail in the following description. In the drawings.

Figure 1:
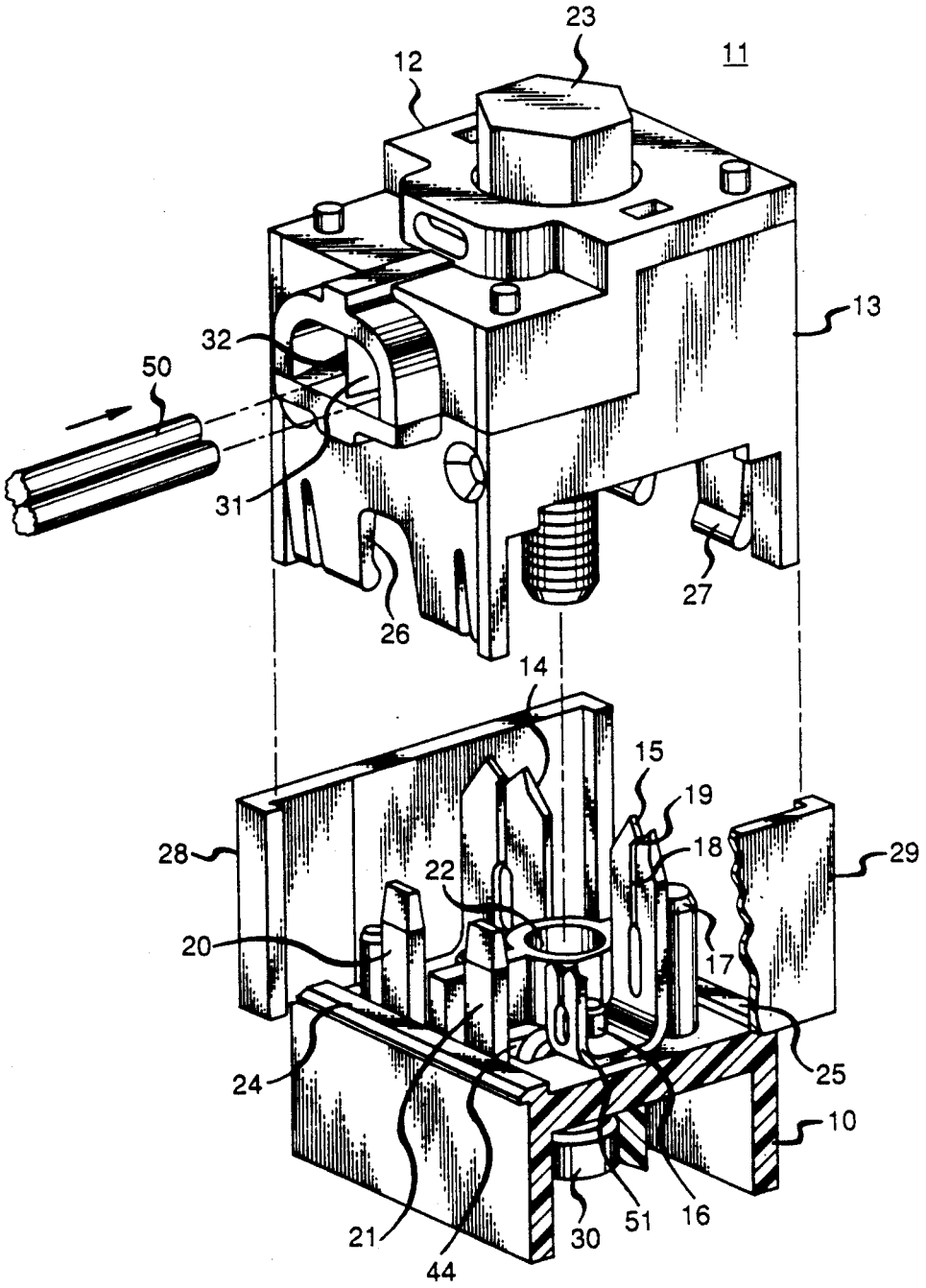
FIG. 1 is an exploded perspective view of a terminal block in accordance with an embodiment of the invention.

It will be appreciated that, for purposes of illustration, these figures are not necessarily drawn to scale.

DETAILED DESCRIPTION

FIGS. 1–4 illustrate one form of the terminal block in accordance with the invention. While the figures show a single block, it will be appreciated that several such blocks can be fabricated on a single base.

The block primarily includes a base (10) and a cover member (11) which comprises a top section (12) and bottom section (13) all formed by standard molding of a plastic material. A pair of insulation displacement contacts (14 and 15) are mounted to the base, in this example, by inserting a hole in the contact over a pillar (16) in the base and supporting the back of the contact by a second pillar (17) (see, also, FIG. 3). A portion of the forward section of the contact bends downwardly into a hole (44) in the base and extends out through the bottom so that apparatus can be connected thereto by wire wrapping around the extended portion (not shown).

As shown in FIG. 1, the rearward section of the contact, which is supported by the pillar (17), includes an opening in the form of a groove (18) extending vertically along the contact portion. The jaws (19) of the groove, as well as the edges of the groove, have sharp surfaces designed to pierce the insulation of wires which are inserted into the groove in accordance with standard insulation displacement contacts. Also molded into the base are posts (20 and 21) which are aligned with respective contacts (14 and 15) so that when a wire is inserted therein in a manner to be described, a portion of the wires will be clamped between the posts associated with that contact (e.g., 17 and 21) and the upper surface of section (13).

The base further includes a hole (22) for receiving a screw (23) from the cover member (11) and ledge portions (24 and 25) on the front and back of the block for engaging clip portions (26 and 27) on the cover member. Side walls (28 and 29) complete the housing enclosure and separate the individual blocks in the cases where an array of terminals is fabricated on a single base. The underside of the base includes a threaded insert (30) within the hole (22) for receiving the screw (23) from the cover member.

Figure 3:
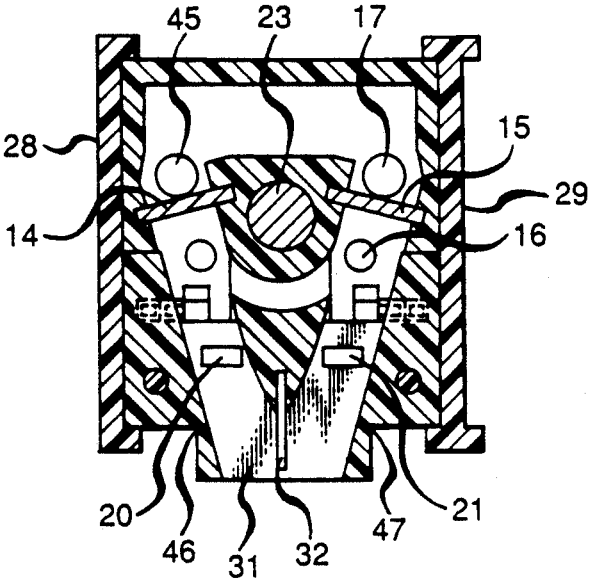
FIG. 3 is a cross-sectional top view of a portion of the device of FIG. 1.

As best seen in FIGS. 1 and 3, the top portion (12) of the cover member (11) includes an entrance port (31) which has mounted therein an element (32) with a sharp vertical edge, such as a knife or razor blade. The element divides the entrance port into two essentially equal parts. Passageways are formed by the element and molded sections of the cover member portions (12 and 13) over the strain relief posts (17, 20, 21, and 45) and the contacts (14 and 15).

Figure 2:
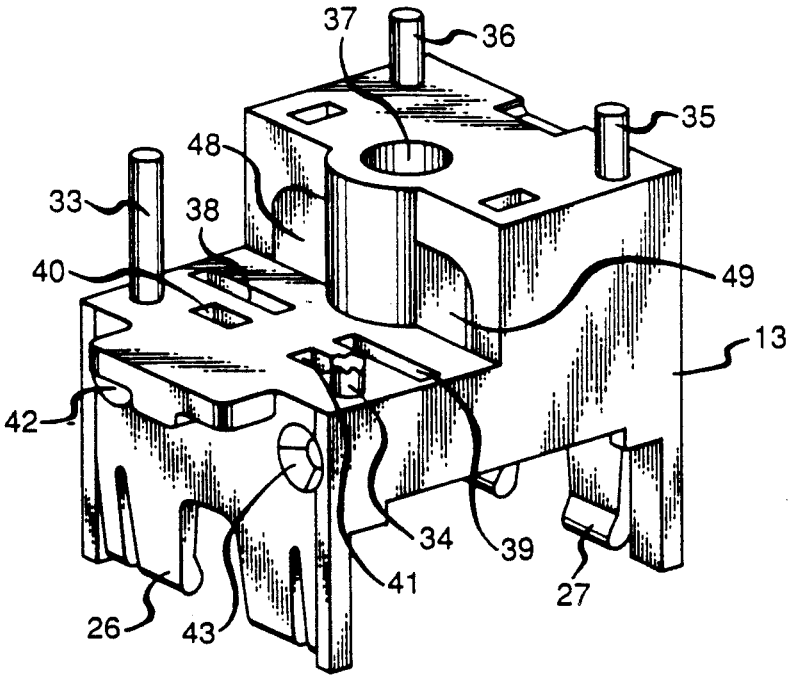
FIG. 2 is a perspective view of a portion of the device of FIG. 1.

As illustrated in FIG. 2, the bottom portion (13) of the cover member includes posts (33–36) for mounting of the top portion (12) thereon, and a hole (37) for receiving the screw (23) therethrough. The bottom portion further includes openings (40 and 41) which permit the strain relief posts (20 and 21) to extend into the top portion. Openings (48 and 49) provide a continuation of the passageways (46 and 47) from the top portion (12) (see FIG. 3).

Figure 4:
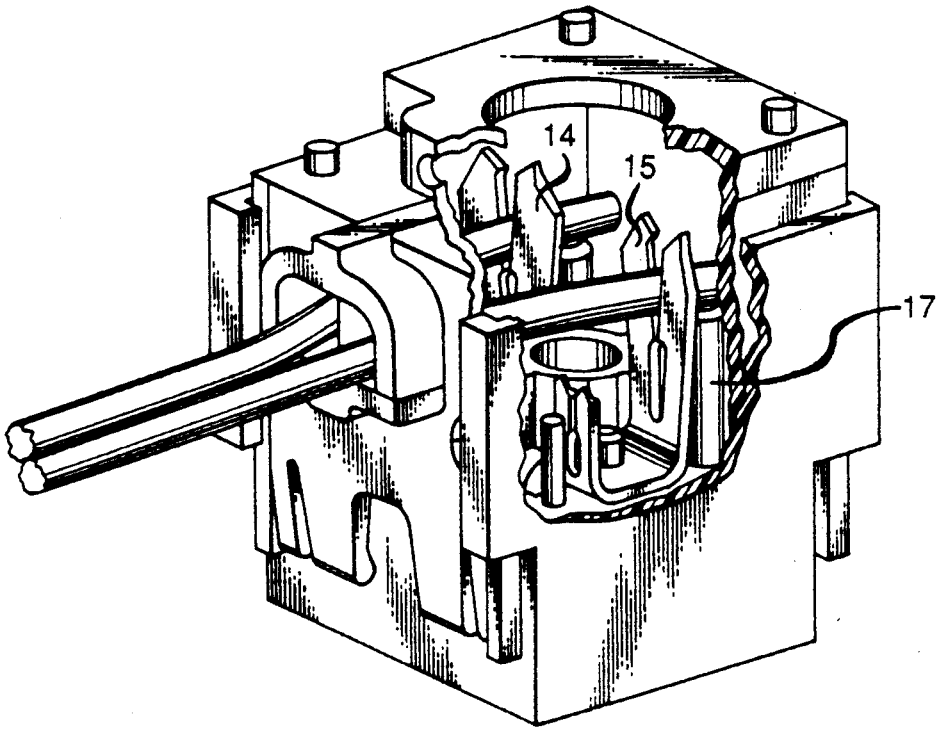
FIG. 4 is a partly broken away view of the device of FIG. 1 showing the insertion of a wire pair therein.

In the operation of the device, once the clip portions (26 and 27) of cover member (11) engage the ledge portions (24 and 25) of the base, the cover member is in its uppermost position, but is free to move further downward by rotation of the screw (23). While in the uppermost position, an insulated wire pair (50) is inserted into the entrance port (31). As the wire pair is inserted, the blade (32) will separate them into individual wires, and these individual wires will be directed through the passageways (46, 47, 48, and 49) of portions 12 and 13 to an area over their respective contacts (14 and 15). That is, each wire will rest in the jaw (e.g., 19) of the rearward portion for the contact (14 or 15) to which it will be electrically connected. Screw (23) is then rotated causing cover member (11) to descend and force each wire into the opening (e.g., 18) in its associated contact. Forcing the wires into the openings will cause penetration of the insulation surrounding the wire, thereby resulting in an electrical connection between the wire and its associated contact. This condition is illustrated in FIG. 4. It will also be noted that each wire rests on an associated post (e.g., 17 and 21) to prevent bending of the wire. It will further be noted that the passageways (46, 48 and 47, 49) are at an angle which aids in separating the wires as they are drawn through the entrance port and cut by the blade. In this example, the angle was approximately 14 degrees, but angles within the range 5 to 25 degrees may be beneficial. In order to prevent undue bending of the wires, the faces of the contacts (14 and 15) are also at an angle to each other so as to be essentially perpendicular to the passageways (ie, at an angle which is the supplement to the angle of the passageways).

Additional features of the terminal block include forward sections (e.g., 51) of the contacts (e.g., 15) which also possess insulation displacement capabilities. These portions are capable of receiving small diameter wires by insertion of said wires into holes (e.g., 43 of FIG. 2) in the front surface of portion (13) of the cover member. These wires will also be pushed into the grooves of the front portion when the cover member is screwed down.

Various modifications of the invention will become apparent to those skilled in the art. All such variations which basically rely on the teachings through which the invention has advanced the art are properly considered within the scope of the invention.

I claim:

1. A terminal block comprising:

a housing including an entrance port defined therein;

a separation member including a sharp edge located at said entrance port, so as to cut an insulated pair of wires inserted at said entrance port into individual wires;

a pair of contact members situated within said housing, each contact member including an opening for insertion of a wire therein, the opening being defined by edges which are capable of piercing insulation surrounding said wire, and the contact members being aligned with the entrance port and separation member so that each individual wire cut from the wire pair is positioned above an opening in an associated contact member; and means for pressing each wire into the opening of its associated contact member.

2. The device according to claim 1 wherein the housing includes a cover member and the entrance port is defined within the cover member, and the means for pressing each wire comprises a screw which moves the cover member in a vertical direction.

3. The device according to claim 1 further comprising a pair of posts aligned with said pair of contact members so that the wires inserted in said contacts will rest upon the posts.

4. The device according to claim 1 wherein the separation member comprises a blade.

5. The device according to claim 1 wherein the housing is a molded material and includes a base member on which the contact members are mounted, and a cover member including said entrance port and passageways for directing each wire to an area above its associated contact member.

6. The device according to claim 5 wherein the cover member is slidably mounted over the base member, and movement is actuated by a screw extending from the cover member to a hole in the base member.

7. The device according to claim 5 wherein the contact members are mounted to the base member by posts extending from the base member.

8. The device according to claim 5 wherein the major surfaces of the contact members are at an angle to each other which is the supplement of the angle of the passageways to each other and the angle of the passageways to each other is at least 5 degrees.

* * * * *